United States Patent [19]

Luyckx

[11] 4,390,498

[45] * Jun. 28, 1983

[54] TITANIUM-BORON ADDITIVE ALLOYS

[76] Inventor: Leon A. Luyckx, 226 Hazelcroft Ave., New Castle, Pa. 16105

[ * ] Notice: The portion of the term of this patent subsequent to Jan. 19, 1999, has been disclaimed.

[21] Appl. No.: 284,198

[22] Filed: Jul. 17, 1981

Related U.S. Application Data

[63] Continuation-in-part of Ser. No. 146,452, May 5, 1980, Pat. No. 4,311,523.

[51] Int. Cl.[3] ..... C22C 14/00

[52] U.S. Cl. ..... 420/420; 420/417; 75/53; 75/58

[58] Field of Search ..... 75/53, 57, 58, 123 B, 75/123 M, 124, 175.5

[56] References Cited

U.S. PATENT DOCUMENTS

| | | | |
|---|---|---|---|
| 2,377,403 | 6/1945 | Crafts | 75/58 |
| 2,661,286 | 12/1953 | Swazy et al. | 75/175.5 |
| 2,858,209 | 10/1958 | Wyche | 75/175.5 |
| 4,311,523 | 11/1982 | Luyckx | 75/175.5 |

FOREIGN PATENT DOCUMENTS

| | | | |
|---|---|---|---|
| 587580 | 11/1959 | Canada | 75/175.5 |
| 1123116 | 2/1962 | Fed. Rep. of Germany | 75/175.5 |
| 978758 | 11/1964 | United Kingdom | 75/175.5 |
| 1016437 | 12/1966 | United Kingdom | 75/175.5 |

*Primary Examiner*—L. Dewayne Rutledge
*Assistant Examiner*—Christopher W. Brody
*Attorney, Agent, or Firm*—Buell, Blenko, Ziesenheim & Beck

[57] ABSTRACT

A new high concentration titanium-boron additive alloy for addition to molten metals is provided comprising about 60% to 78% titanium, about 1.3% to 4.5% boron and the balance iron with residual impurities in ordinary amounts. Aluminum, zirconium, silicon and manganese may be present in an amount up to about 20% so long as the ratio of titanium to boron remains in the range.

10 Claims, No Drawings

TITANIUM-BORON ADDITIVE ALLOYS

This application is a continuation in part of my copending application, Ser. No. 146,452, filed May 5, 1980, now U.S. Pat. No. 4,311,523.

This invention relates to titanium-boron additive alloys and particularly to high concentration titanium-boron additive alloys for deep hardening of steel.

Boron, as an additive alloy in specialty alloy compositions, has been known since the early 1920's, as for example, in high speed cutting tools described in Franks and Field U.S. Pat. No. 1,684,131 of September 1928.

The large scale use of boron in carbon steels came about by accident some ten or more years later. Borax was used as a flux to aid in the difficult melting of titanium-aluminum deoxidizer compositions in the submerged arc furnace. At that time, the transition from silicon killed, coarse grained steels to aluminum killed, fine grained steels was occurring. It was found that these aluminum killed steels while having the advantages of toughness and cleanliness had lost the quench hardening properties of the coarse grained steels. It was found, however, that the boron fluxed titanium-aluminum alloy compositions would improve the quench-hardening properties. This was at first believed to be the result of the titanium addition but careful testing proved this to be incorrect and the art settled upon boron as being responsible for this great increase in quench hardening depth. Boron, as an additive, became popular and took hold faster than the understanding of the mechanism involved. However, it was discovered that in many cases, even with boron present, the desired quench hardening effect did not occur. This led to various proposals for protection of the boron against oxidation by the compounding of various materials such as the silicon-boron alloy known as Borosil, rare earth-boron compositions such as that in Bolkcom and Knapp U.S. Pat. No. 2,850,381, various calcium-boron, and aluminum boron alloys. Deep hardening still eluded the efforts of metallurgists although boron was retained in significant quantities. Most metallurgists now agree that it is essential to prevent the reaction of boron, not only with oxygen, but also with nitrogen if the deep-hardening process is to proceed during quenching. It is also now generally agreed that only titanium and zirconium are capable of effectively preventing the formation of boron nitrides.

In order to provide these protective elements the additive alloy known as Grainal 79 in the trade was developed. Its composition was and is about 0.5% boron, 20% titanium, 13% aluminum, 4% zirconium, 8% manganese, 5% max silicon and the balance iron. There have been various attempts to increase the boron content of comparable alloys but without success. An example is U.S. Pat. No. 2,616,797 to Efimoff which proved unsuccessful in providing the necessary protection for the boron and in actual use required separate additions of titanium or zirconium to protect the boron.

I have discovered a new titanium-boron additive alloy which solves these problems. The alloy of this invention provides complete protection for the boron without adding any of the expensive alloys which were believed necessary in the prior art practices.

I have discovered a titanium-boron additive alloy whose composition is broadly:

Titanium: 60%–78%
Boron: 1.3%–4.5%

Iron: Balance with usual impurities in ordinary amounts.

A narrower range of composition is:

Titanium: 65%–75%
Boron: 1.6%–1.9%
Iron: Balance with usual impurities in ordinary amounts.

A preferred composition range is:

Titanium: 68%–72%
Boron: 1.6%–1.9%
Aluminum: 3.5%–7.5%
Vanadium: 1.0%–3.0%
Iron: Balance with usual impurities in ordinary amounts.

I have found that aluminum, zirconium, manganese and silicon may be present in substantial amounts up to about 20% so long as the ratios of titanium and boron are maintained such that the titanium content is approximately at the titanium-iron eutectic (about 68% titanium), preferably on the high side for titanium (about 70%) and the titanium boron ratio is held between 30/1 and 50/1, preferably about 40/1.

Inherited residuals from alloy scrap such as vanadium, molybdenum etc. may be present in small residual amounts not exceeding 5%. Contaminating impurities carbon, nitrogen and oxygen should be avoided at all costs.

Homogeneity is desirable in the alloy of this invention and may be achieved by rapid cooling of the alloy from the liquid to the solid state. This may be accomplished in various ways. I have found that it can be accomplished satisfactorily by casting from the production furnace or transfer ladle directly onto a metal chill plate or by granulating or atomizing the liquid alloy in a stream of argon gas or cold water.

In the foregoing specification I have set out certain preferred practices and embodiments of my invention, however, it will be understood that this invention may be otherwise practiced within the scope of the following claims.

I claim:

1. A high concentration titanium-boron additive alloy for addition to liquid metal such as steel comprising about 60% to 78% titanium, about 1.3% to 4.5% boron and the balance iron with usual impurities in ordinary amounts.

2. A high concentration titanium-boron alloy as claimed in claim 1 having about 65% to 75% titanium, about 1.6% to 1.9% boron and the balance iron with usual impurities in ordinary amounts.

3. A high concentration titanium-boron alloy as claimed in claim 1 having about 68% to 72% titanium, about 1.6% to 1.9% boron and the balance iron with usual impurities in ordinary amounts.

4. A high concentration titanium-boron alloy as claimed in claim 1, or 2 or 3 having up to 20% of one or more of the elements zirconium, aluminum, silicon and manganese.

5. A high concentration titanium-boron alloy as claimed in claim 4 having a ratio of titanium to boron in the range 30/1 to 50/1 with the titanium content at approximately the titanium-boron eutectic.

6. A high concentration titanium-boron alloy as claimed in claim 4 having a ratio of titanium to boron of about 40/1 with the titanium content at approximately the titanium-iron eutectic.

7. A high concentration titanium-boron alloy as claimed in claim 1 or 2 or 3 having a ratio of titanium to boron in the range 30/1 to 50/1 with the titanium content at approximately the titanium-iron eutectic.

8. A high concentration titanium-boron alloy as claimed in claim 1 or 2 or 3 having a ratio of titanium to boron of about 40/1 with the titanium content at approximately the titanium iron eutectic.

9. A high concentration titanium-boron alloy as claimed in claim 1 or 2 or 3 in which the homogeneity of the composition is insured by rapid cooling and solidification of the alloy from the liquid to the solid state.

10. A high concentration titanium-boron alloy as claimed in claim 4 containing 3.5% to 7.5% aluminum and 1.0% to 3.0% vanadium.

* * * * *

UNITED STATES PATENT AND TRADEMARK OFFICE

CERTIFICATE OF CORRECTION

PATENT NO. : 4,390,498

DATED : June 28, 1983

INVENTOR(S) : Leon A. Luyckx

It is certified that error appears in the above-identified patent and that said Letters Patent is hereby corrected as shown below:

On the Title Page, under "References Cited", the Luyckx patent should have the issue date of --1/1982--.

Claim 5, column 2, line 62, "titanium-boron" should be --titanium-iron--.

Signed and Sealed this

*Thirteenth* Day of *September 1983*

[SEAL]

*Attest:*

GERALD J. MOSSINGHOFF

*Attesting Officer*

*Commissioner of Patents and Trademarks*